United States Patent [19]

Tsuhako

[11] 4,441,540

[45] Apr. 10, 1984

[54] BOTTOM RAIL STRUCTURAL CONFIGURATION FOR A VENETIAN BLIND

[75] Inventor: Parker I. Tsuhako, Gardena, Calif.

[73] Assignee: Ohline Corporation, Gardena, Calif.

[21] Appl. No.: 373,406

[22] Filed: Apr. 30, 1982

[51] Int. Cl.[3] ..... E06B 9/303

[52] U.S. Cl. ..... 160/168 R; 160/178 R

[58] Field of Search ..... 160/168 R, 168 A, 178 E, 160/178 F, 173, 178 R

[56] References Cited

U.S. PATENT DOCUMENTS

| | | | |
|---|---|---|---|
| 2,307,278 | 1/1943 | Krantz | 160/168 A |
| 2,643,713 | 6/1953 | Mayer | 160/178 R |
| 3,605,852 | 9/1971 | Vecchiarelli | 160/168 |

*Primary Examiner*—Peter M. Caun
*Assistant Examiner*—Cherney S. Lieberman
*Attorney, Agent, or Firm*—Henry M. Bissell

[57] ABSTRACT

An improvement in a Venetian blind comprises a bottom rail in openable box form containing means for permitting easy adjustment of the length of the lift cords and slat ladders of the blind, and therefore the overall length of the blind, to adapt it to different window lengths. Preferably, the box comprises a horizontal lower bottom portion with closed bottom and upraised sloped sides and a horizontal upper portion with closed top and depending sloped sides, the latter usually fitting closely between the upraised sides. The two portions are releasably held together, as by removable pins extending therethrough. The lower edges of the depending sides can define inverted V-shaped keeper slots or the like to releasably retain the vertical string portions of the ladders. The upper portion may have apertures in the top down through which the lift cords pass. Knots can be repositioned in the ends of the lift cords and the vertical string portions to releasably and adjustably retain the lift cord and ladder ends within the bottom rail.

10 Claims, 2 Drawing Figures

BOTTOM RAIL STRUCTURAL CONFIGURATION FOR A VENETIAN BLIND

BACKGROUND OF THE INVENTION

1. Field of the Invention

The present invention generally relates to window coverings and more particularly, to improvements in Venetian blinds.

2. Description of the Prior Art

Conventional Venetian blinds are fabricated in various standard lengths and must be custom made if other lengths are desired, thus raising their cost to the purchaser. In many cases, windows to be outfitted with Venetian blinds require such customization. In some instances the user, after purchasing the Venetian blind, will wish to move it from one window to another, but will find that the window lengths differ sufficiently to cause a fitting problem, thus necessitating returning the Venetian blind to the factory for shortening or lengthening, or necessitating the purchase of another customized Venetian blind. Although a Venetian blind can be pulled up by its lift cords to temporarily shorten it, the resulting closely stacked lower portion of the blind detracts from the overall visual appearance of the blind, so that customizing the length of the blind is preferred.

It would be desirable to be able to provide improvements in a Venetian blind which would enable one to readily adjust the length of the blind without having to return it to the manufacturer for customizing. Such improvements should be simple and effective and be performable by anyone without special tools. Moreover, the improvements should not substantially increase the cost of the blind or materially alter its appearance.

SUMMARY OF THE INVENTION

The improvements in a Venetian blind which form the present invention satisfy the foregoing needs. Such improvements are substantially as set forth in the Abstract above. They comprise a bottom rail in the form of a readily openable box which receives and adjustably holds and conceals the lower ends of the string slat ladders and lift cords. The box may include keeper slots or the like and various other apertures. Knots can be placed in various locations in the ends of the cords and ladders and serve to shorten and lengthen the effective lengths thereof and retain the ends in the slots and apertures. Alternatively releasable clamps can be disposed in the box for such purposes. The box can be, for example, in the form of upper and lower portions releasably secured together as by removable pins, etc. Various other features are set forth in the following detailed description and accompanying drawings.

DETAILED DESCRIPTION OF THE PREFERRED EMBODIMENTS

Figure 1:
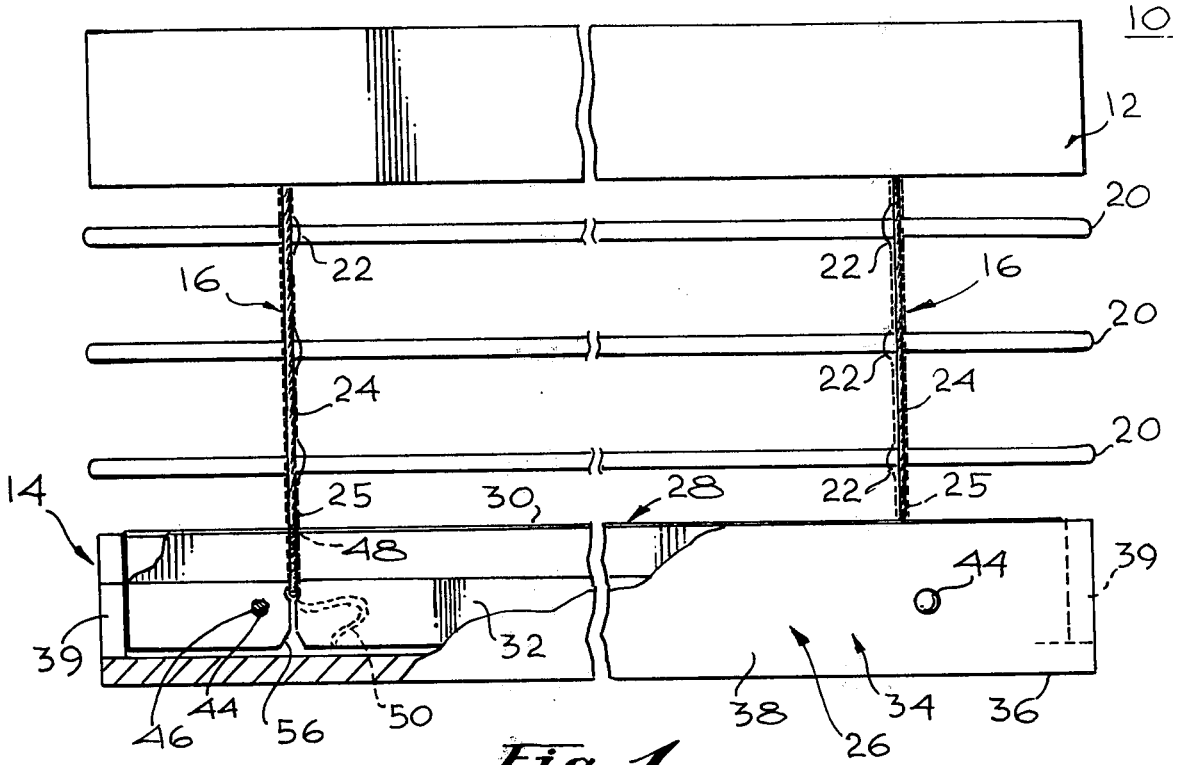
FIG. 1 is a fragmentary schematic rear elevation, partly broken away, of a preferred embodiment of the improvements in a Venetian blind in accordance with the present invention.
Figure 2:
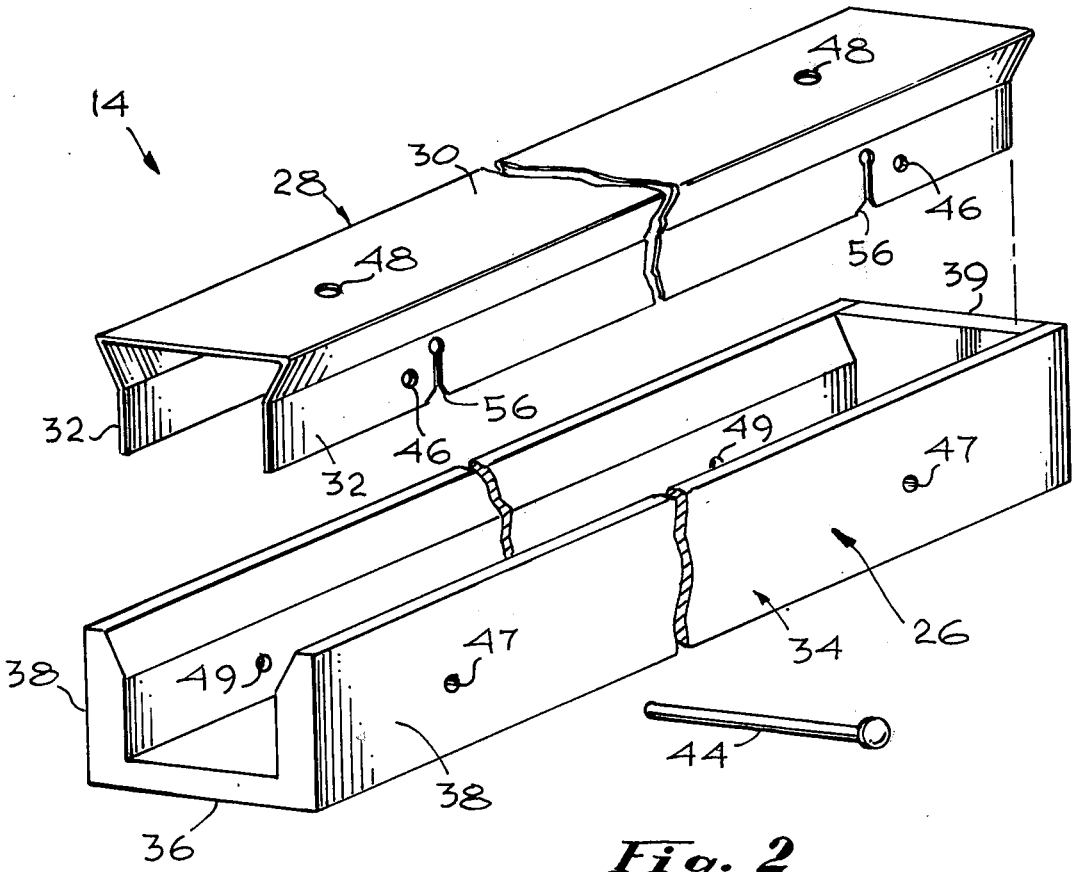
FIG. 2 is an exploded perspective view of the bottom rail of FIG. 1.

One preferred embodiment of the improvements in a Venetian blind is schematically depicted in FIGS. 1 and 2. Thus, a Venetian blind 10 is shown, which blind is largely of conventional construction and materials. It comprises a horizontal top rail 12, a horizontal bottom rail 14, and a pair of horizontally spaced, vertical string slat ladders 16 connected at their opposite ends to rails 12 and 14 and supporting vertically spaced, horizontally extending slats 20 on horizontal string ladder rungs 22.

Rungs 22 are connected at their opposite ends to vertical ladder strings 24 to form ladders 16. Blind 10 includes a spaced vertical pair of lift cords 25 disposed at ladders 16 between ladder strings 24 and passing through apertures (not shown) in slats 20. Lift cords 25 are connected at their upper ends within top rail 12 to a conventional lift mechanism (not shown) and at their bottom ends to bottom rail 14. Blind 10 may also include conventional tilt cords (not shown) connected to a conventional tilt mechanism (not shown) and to ladders 16 for tilting slats 20 at desired angles for shading purposes.

The improvements of the present invention comprise the novel construction of bottom rail 14. Thus, rail 14 is an openable box 26 comprising a horizontal upper box member 28 having a flat closed top 30 and depending sides 32 which slope toward each other, and a horizontal lower box member 34 with a closed bottom 36 and upraised sides 38 configured and dimensioned to closely approximate sides 32 which are disposed therewithin. End closures 39, only one of which is shown at the far end of FIG. 2, are provided for each end of the lower box member and attached, as by gluing for example. The end closures 39 may be provided with a simulated woodgrain finish to match the sidewalls of the lower box member 34. Member 28 fits within member 34 so that top 30 is about flush with the upper ends of sides 38 when members 28 and 34 are releasably secured together, as shown in FIG. 1, as by removable horizontal pins 44 in aligned apertures 46, 47 in members 28 and 34, respectively. The pins 44, when the device is assembled, extend through the apertures 46, 47 and into openings 49 in the opposite interior face of side 38. These openings 49 do not extend all the way through, thus leaving the front face of the box member 34 (far side of FIG. 2) unblemished. Thus the fasteners for the device are not visible from the front.

Top 30 has vertical apertures 48 therethrough connecting with the hollow interior of box 26. The lower ends of lift cords 25 are received through apertures 48 and releasably knotted to retain ends 50 at a selected adjustable length within box 26. The length of blind 10 is thereby fully adjustable. It is also necessary to adjust the length of ladders 16 to conform to the length of cords 25. This is accomplished by running vertical strings 24 of each ladder 16 around the outside of sides 32 (when lower member 34 is removed), passing their lower ends through inverted V-shaped keeper slots 56 in the lower ends of sides 32 and knotting the ends at the correct length to retain them in place in box 26. Since sides 32 and 38 closely approximate each other when box 26 is assembled, the ends of the strings 24 in assembled box 26 are wedged between sides 32 and 38 and are additionally held in place by this wedging action.

Accordingly, blind 10 can be easily adjusted at will in overall length to the length of the window to be covered by blind 10, by adjusting cords 25 and strings 24 within box 26, after opening box 26 by pulling out pins 44 from apertures 46, 47 and separating members 28 and 34. Box 26 can then be closed by realigning members 28 and 34 and pushing pins 44 into apertures 47 and through apertures 46. This totally conceals the cord and string ends from view for a neat, finished appearance. Reopening of box 26 and readjustment of the length of the cord and string ends therein can be done whenever needed. Thus, blind 10 is fully readjustable in length for improved performance without any significant increase in cost over a conventional Venetian blind. Box 26 totally conceals the ladder string ends and lift cord ends 50 for a tidy appearance.

Although there has been described above one specific arrangement of a bottom rail structural configuration for a Venetian blind in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. In a Venetian blind having:

(a) a plurality of thin horizontally disposed slats;

(b) a horizontal head rail above and a horizontal bottom rail below said slats;

(c) a plurality of horizontally spaced flexible string ladders connected between said head rail and said bottom rail for holding said slats in vertically spaced relation, one above another between said rails; and (d) a plurality of lift cords extending from said head rail and connected to said bottom rail for movement of said bottom rail, ladders and slats toward and away from said head rail;

the improvement which comprises:

a bottom rail which is an openable box and which contains holding means for individually adjusting the effective lengths of said lift cords and ladder strings, said holding means being concealed from view when the box is closed; and releasable means for maintaining the box in a closed position, said releasable means being invisible from the front side of the blind;

the bottom rail further comprising:

(e) a generally horizontally extending lower member having a closed bottom and upraised sides; and (f) a generally horizontally extending upper member with closed top and depending sides;

wherein a plurality of spaced transverse pins releasably extend through aligned openings in said depending sides of the upper member and the upraised rear side of the lower member and into openings in the upraised front side of the lower member which do not extend entirely through said front side, thereby leaving the front face of the bottom rail unblemished.

2. The improvement of claim 1 wherein said box includes end closures and wherein the top of said box defines lift cord-receiving openings.

3. The improvement of claim 2 wherein said depending sides of said upper member are configured to mate within the upraised sides of said lower member, and wherein the bottom edges of said depending sides define separate inverted V-shaped keeper slots for individually and releasably retaining the knotted ends of said ladders.

4. The improvement of claim 3 wherein each of said ladders comprises a pair of spaced vertical strings spanned by vertically spaced horizontal string rungs, and wherein a separate one of said vertical ladder strings is disposed in each of said keeper slots.

5. The improvement of claim 4 wherein said depending sides are sloped toward each other and wherein said upraised sides are dimensioned and configured to approximate said depending sides so as to releasably retain the lower ends of said ladder strings therebetween.

6. The improvement of claim 5 wherein said lift cords extend through and are knotted below said lift cord-receiving openings to releasably retain the lift cords therein, and wherein said vertical ladder strings are knotted to prevent release through said keeper slots.

7. The improvement of claim 2 wherein the end closures are fitted and mounted within respective ends of the lower member, the sidewalls of the lower member and the end closures being provided with matching woodgrain finish.

8. The improvement of claim 1 wherein when the bottom rail box is open, the ends of the lift cords and the ends of the ladder strings are exposed and accessible for ease of length adjustment.

9. The improvement of claim 1 wherein the upper and lower members of the bottom rail are separable to provide access to the ends of the lift cords and the ladder strings.

10. The improvement of claim 1 wherein the lift cords and ladder strings are retained in the upper member by knots adjacent openings in the upper member which are constricted to the respective diameters of the cords and strings.

* * * * *